United States Patent [19]

Walter et al.

[11] Patent Number: 4,613,388

[45] **Date of Patent: * Sep. 23, 1986**

[54] SUPERPLASTIC ALLOYS FORMED BY ELECTRODEPOSITION

[75] Inventors: Robert J. Walter, Thousand Oaks; Harold E. Marker, Northridge, both of Calif.

[73] Assignee: Rockwell International Corporation, El Segundo, Calif.

[ * ] Notice: The portion of the term of this patent subsequent to Aug. 23, 2000 has been disclaimed.

[21] Appl. No.: 419,273

[22] Filed: Sep. 17, 1982

[51] Int. Cl.[4] ..... C22C 19/07

[52] U.S. Cl. ..... 148/425; 148/426; 420/902; 204/43.1; 204/44.5; 204/123

[58] Field of Search ..... 204/43 R, 43 T, 140, 204/141.5, 144, 43.1, 44.5, 71, 123; 148/11.5 N, 425, 426; 428/561, 562, 616–619; 72/364; 420/902

[56] References Cited

U.S. PATENT DOCUMENTS

| | | | |
|---|---|---|---|
| 3,519,419 | 7/1970 | Gibson | 75/171 |
| 3,574,002 | 4/1971 | Hayden et al. | 148/37 |
| 3,804,726 | 4/1974 | Passol | 204/43 T |
| 3,976,482 | 8/1976 | Larson | 419/30 |
| 4,066,117 | 1/1978 | Clark et al. | 164/46 |
| 4,066,449 | 1/1978 | Havel | 419/49 |
| 4,081,295 | 3/1978 | Vogel | 148/11.5 N |
| 4,153,453 | 5/1979 | Hart et al. | 75/123 J |
| 4,191,617 | 3/1980 | Hurley et al. | 204/40 |
| 4,297,405 | 10/1981 | Kasahara et al. | 428/141 |
| 4,400,442 | 8/1983 | Lewis et al. | 428/544 |
| 4,418,124 | 11/1983 | Jackson et al. | 428/548 |
| 4,439,284 | 3/1984 | Walter | 204/43 T |

OTHER PUBLICATIONS

"Electroplating", *Kirk-Othmer Encyclopedia of Chemical Technology*, John Wiley & Sons, N.Y. (1979), vol. 8, pp. 826–869.

"High Temperature Alloys", High Temperature Composites-Kirk-Othmer Encyclopedia of Chem. Tech., Wiley & Sons, N.Y. (1980), vol. 12, pp. 417–481.

*Primary Examiner*—Edward A. Miller

*Attorney, Agent, or Firm*—H. Fredrick Hamann; Harry B. Field; Lawrence N. Ginsberg

[57] ABSTRACT

There are provided superplastic alloys formed by electrodeposition of the alloy onto a cathode from an electrolyte containing a first metal ion, which is iron, nickel or cobalt, and a second constituent different from the first, which is iron, nickel, cobalt, tungsten or molybdenum, or a colloidal dispersoid. The products formed are fine-grain deposits free of intergranular embrittling films, and exhibit grain boundary flow at a superplastic temperature below a recrystallization temperature of the deposit. Nickel-cobalt alloys are preferred, and are deposited from halide-free sulfamate baths, with care being taken to eliminate all anode oxides from the system. In a complex structure, the approximate initial hardware contour is formed by electrodeposition, and the final structure formed by superplastic forming.

44 Claims, No Drawings

SUPERPLASTIC ALLOYS FORMED BY ELECTRODEPOSITION

BACKGROUND OF THE INVENTION

The present invention is directed to providing novel electrodeposited superplastic alloys preferably containing at least one metal from the fourth period of Group VIII of the Periodic Table.

Superplastic alloy formed of Ti-6Al-4V is known and described by Collins and Highberger in "Superplastic Forming/Diffusion Bonding: An Update", *Metal Progress*, pp. 79–83 (March, 1981). The criticality of fine grain size or large grain boundary area to superplastic properties is set forth in the article. The products are wrought and require temperatures in excess of 1500° F. for superplastic forming.

It has been known that nickel can be electroplated alone or with othe rmetal ions, with nickel-cobalt alloys being dominant. The comparatively low recrystallization temperature, i.e., about 700° F., results in pure nickel deposits in grain growth at a temperature below which superplastic grain boundary movement can occur. Emphasis in the instance of nickel alloy deposits has been to form bright deposits through the addition of additives which reduce ductility or tensile elongation.

To this end conventional plating solutions contain varying amounts of many impurities needed to form bright deposits. While emphasis has been placed upon developing additional agents that will allow the deposits to tolerate the presence of the impurities, no effort has been made to remove them.

The impurities are introduced from many sources. Examples are impurities inherent in the metal salts, impurities introduced as the anode corrodes, impurities introduced by the cathode which are carried over as "drag-out" from a prior bath, impurities from the water, and even impurities from airborne sources. All can contribute to forming nickel and nickel alloy deposits with reduced grain boundary plasticity and increase as deposited grain size.

SUMMARY OF THE INVENTION

The present invention provides a method of producing electrodeposited alloys from electrolyte solutions which are halide-free and highly pure by substantially restricting, if not eliminating, the amount of ingredients or additives present in the electrolyte, and have surprisingly been found to display superplastic characteristics heretofore unknown in electrodeposited alloys of the compositions described herein. The invention also relates to the utilization of superplastic properties in the formation of structural end products.

Superplastic alloys are formed in accordance with the present invention by deposition from a halide-free electrolyte, substantially free of ingredients that increase grain size or form an intergranular embrittling film. The electrolyte comprises a first metal ion selected from the fourth period of Group VIII of the Periodic Table and at least one other metal ion different from the first metal ion, preferably selected from the same period and group of the Periodic Table, tungsten or molybdenum, and/or particulate dispersoids which are free metal powders, metal oxides and metal carbides of a metal other than one from the fourth period of Group VIII. A superplastic, fine-grain metal alloy deposit is formed having increased elevated temperature strength and recrystallization temperature. The deposit does not prevent grain boundary flow at a superplastic temperature below the recrystallization temperature of the deposit. Dispersoids are colloidal in nature and should be of a particle size less than about 1$\mu$. The deposits have a characteristic tensile elongation of at least about 70 percent at some superplastic temperature below the recrystallization temperature, and preferably in excess of 100 percent. Magnification to at least about 20,000× is normally required for grain resolution.

The presently preferred superplastic alloys are nickel-cobalt alloys, comprising from about 30 percent to about 70 percent by weight cobalt, preferably from about 40 percent to about 60 percent by weight cobalt, and more preferably from about 40 percent to about 50 percent by weight cobalt, and deposited from a sulfamate-based electrolyte in a system free of nickel oxide in which the nickel to cobalt ratio is in the order of from about 10 to 1 to about 25 to 1, preferably from about 15 to 1 to about 20 to 1. Deposition preferably occurs at a pH from about 3.8 to about 4.2 at current densities ranging from about 5 to about 60 amps/ft$^2$, more preferably from about 20 to about 40 amps/ft$^2$.

A surfactant may be added to the solution in an amount which will reduce surface pitting without being included into the deposit to the extent that it affects the grain structure.

The present invention is also directed to producing superplastic structure by mechanical working of an electrodeposited superplastic alloy precursor to a desired end structure. The method comprises the combination of electrodepositing a superplastic alloy to the intermediate structure and superplastic forming of the intermediate structure to the final dimensions. Superplastic forming is by tensile deformation at elevated temperatures below the recrystallization temperature of the alloy and involves grain boundary sliding, or flow, utilizing extremely small grain size of the superplastic alloy.

Superplastic forming requires a slow deformation rate at the elevated temperatures. This may be followed by diffusion bonding to obtain 3-dimensional enclosed shapes and seal enclosed cavities and channels.

DETAILED DESCRIPTION

According to the present invention, there are provided novel superplastic alloys, a process for their formation, and a process for formation of complex structures therefrom. The superplastic alloys provided in accordance with the invention are electrodeposited from an electrolyte substantially free of ingredients which promote as deposited grain growth or intergranular embrittlement.

It is presently preferred that deposition occur from a halide-free electrolyte comprising a salt of at least one metal selected from the fourth period of Group VIII of the Periodic Table of the Elements published in Perry's *Chemical Engineer's Handbook*, namely, nickel, cobalt and iron. Nickel is preferred. There is also in solution a salt of at least one other metal and/or colloidal dispersoids which are metal powders, metal carbides and/or metal oxides in which the metal is other than a metal of the fourth period of Group VIII of the Periodic Table. Other depositable metals include tungsten, molybdenum, and the like.

Besides deposits formed from metal ion combinations, superalloy deposits can be formed from solutions of at least one of the ions $Ni^{++}$, $Fe^{++}$ and $Co^{++}$ and a dispersoid. Dispersoids besides free metals include oxides and carbides such as $SiO_2$, $Al_2O_3$, ThO, SiC, TiC, WC, NbC, CrC and the like, and are colloidal, preferably of a particle size less than about 1μ. Dispersoids in the plating operation take on a positive charge in the acidic electrolyte and migrate by electrophoresis to the cathode and deposit mainly by codeposition entrapment by the depositing metal ions.

A deposit of superplastic alloys may be of any shape. Deposition may be on strippable cathodes, including planar cathodes. Strippable cathodes include titanium, stainless steel and conductive plastics such as plastics which include carbon, aluminum and/or silicon, to induce conductivity. Deposition may also be on cathodes to which the electrodeposit becomes bonded. For example, the superplastic alloy may be deposited onto a previously electrodeposited or wrought superplastic alloy substrate forming an electrochemical bond with the superplastic substrate. Continuous deposits of Ni-Co up to about 0.35 inch have heen achinved hy continuous deposition over a 7-day period. Deposition efficiency for short-duration plating (two days or less) of 99 percent has been observed, with deposition efficiency decreasing as the deposit grows in thickness.

To maintain a proper electrolyte concentration, continuous or periodic addition of the salts of the ionic metals to the electrolyte bath can be employed, as well as controlled corrosion of anodes of the depositing metals. Alloy anodes of the depositing metals can be employed, with the alloy composition controlled to give an effective dissolution rate to the solution in proportion to the concentrations desired for the superplastic alloy to be formed. Separate anodes are preferably employed, with anode corrosion being controlled by separate rectifiers or by current splitting.

Where nickel is employed as an anode and the electrolyte is based on sulfamic acid, there may be employed sulfur depolarized nickel, since the sulfur is insoluble in the sulfamate electrolyte and will deposit in the anode sludge and not interfere with the deposit purity. To this end, sulfur depolarized nickel anodes remain active, even in halogen-free sulfamate electrolytes operated at high current densities.

By "superplastic alloy" there is meant very fine grain alloys which exhibit grain boundary flow and are capable of at least 70 percent elongation, often in excess of 100 percent, above some superplastic temperature below the temperature of recrystallization without "necking". The alloys of the instant invention are of very fine grain size and exhibit grain boundary flow up to the temperature of recrystallization. To this end, so fine are the grains in superplastic electrodeposited nickel-cobalt alloys that magnification of 20,000× is required to resolve grain boundaries. As indicated these nickel-cobalt alloys display superplasticity at a temperature above a minimum temperature required for grain boundary flow but below the temperature of recrystallization. In this temperature range, the alloy stretches uniformly, substantially without necking, at a standard tensile strain rate of from about 3 to about $8\times10^{-4}$ in./in./sec. There is thus achieved a higher deformation rate at a lower temperature as compared to the wrought superplastic alloys which are superplastic formed at a deformation rate of about 2 to about $5\times10^{-4}$ in/in./sec.

By "substantially free of impurities that promote grain growth or intergranular embrittlement" there is meant solutions free of impurities which, if occluded in the deposit, will adversely alter the grain structure and destroy superplasticity.

The functional metals which may be deposited from solution are iron, nickel, cobalt, tungsten and molybdenum. At least one of the metals must be iron, nickel or cobalt.

The alloys are preferably nickel-based and are formed of nickel and cobalt or nickel and iron, preferably nickel and cobalt. Functional nickel-cobalt alloys contain from about 30 to about 70 percent by weight cobalt, preferably from about 40 to about 60 percent by weight cobalt, more preferably from about 40 to about 50 percent by weight cobalt. Nickel-iron alloys can contain from about 2 to about 30 percent by weight iron. All nickel alloys are to be free of nickel oxide, especially nickel oxide from the anode, as hereinafter explained, and their electrolytes are preferably sulfamate-based.

While not limiting, the invention, in respect of electrodeposition will be detailed in terms of providing nickel-cobalt alloy deposits which recrystallize above the superplastic temperature range of from about 900° to about 1200° F.

To provide electrodeposits of desired alloy composition, electrolytes of high nickel content are employed and can contain from about 10 to about 25 parts by weight of ionic nickel to each part by weight ionic cobalt, preferably from about 15 to about 20 parts by weight. The amount of cobalt appearing in the electrodeposited alloy will increase with a decrease in nickel content of the electrolyte. It is presently preferred to employ an electrolyte in which the weight ratio of nickel to cobalt is about 15 to 1. Total metal ion content is about 70 to about 80 grams per liter.

Electrolyte pH is normally from about 3.8 to about 4.2, as sustained by sulfamic acid addition with buffering. Conventional buffering agents such as boric acid may be employed to maintain pH in the desired range without adverse effects.

Wetting agents may be used to reduce surface pitting, as long as the wetting agents do not deleteriously affect the grain structure. Wetting agent concentration can range from about 50 to 100 g/l and in a quantity sufficient to contain a bubble for a minimum of 15 seconds on a 3-inch-diameter ring. Preferred wetting agents are sodium salts of alkyl sulfates containing from about 12 to about 16 carbon atoms. Sodium lauryl sulfate is preferred.

Deposition of an alloy onto a cathode is normally achieved at electrolyte temperatures ranging from about 115° to about 125° F., preferably about 120° F. Current density can range from about 5 to about 60 amps/ft$^2$, preferably from about 20 to about 40 amps/ft$^2$.

To achieve an effective system, it is essential to keep the anode free of anode oxides, for if present, the anode oxide will form angstrom-size particles in the bath, which are carried over along with sulfur from the sulfur depolarized anodes into the deposited alloy and prevent formation of a superplastic deposit.

The most efficient way to sustain the anode in an oxide-free state is to maintain the anode in continuous operation by having present a sacrificial cathode "dummy" or alternate cathode to be used whenever plating of a primary cathode is completed and during change of cathodes.

At startup, or when conditioning the electrolyte before use, the plating bath is operated at low current densities but high rates of electrolyte flow against the cathode. This causes the oxide particles to codeposit on the cathode and are thus removed from the bath. When the bath becomes essentially free of the anode oxide, satisfactory deposits free of sulfur and anode oxide will be obtained.

The composition of the nickel-cobalt deposit is dependent upon electrolyte composition, current density, agitation and pH. Temperature does not significantly influence deposit composition. However, the greatest throwing power is observed for baths operated at a temperature of from about 115° to about 125° F., preferably about 120° F., and give deposits of optimum properties.

To maintain constant deposit composition for nickel-cobalt deposits, it is essential that the electrolyte flow or agitation be adequate to prevent cobalt ion depletion at the cathode, i.e., to prevent composition polarization. Without electrolyte agitation, the amount of nickel in the deposit will linearly increase with a current density as much as 10 percent by weight on a current differential of about 30 amps/ft$^2$. With sufficient agitation, the cobalt concentration in the deposit is charge transfer-controlled rather than diffusion-controlled.

A presently preferred aqueous sulfamic acid-based electrolyte and associated operating conditions are as follows:

| Composition | |
|---|---|
| Component | Concentration |
| Nickel (from Nickel Sulfamate) | 73.3 g/l |
| Cobalt (from Cobalt Sulfamate) | 4.6 g/l |
| SNAP[1] | 0.5 to 1 g/l[2] |
| Boric Acid | 37 g/l (minimum) |

[1]Manufactured and sold by Allied Kelite and formed of Sodium Alkyl/Sulfates.
[2]The concentration is sufficient to contain a bubble a minimum of 15 seconds on a 3"-diameter ring.

| Operating Conditions | |
|---|---|
| pH as maintained by sulfamic acid addition | 3.8 to 4.2 |
| Temperature | 120° F. ± 5° F. |
| Current Density | 40 amps/ft$^2$ |
| Anodes (controlled separately) | Sulfur depolarized Nickel, Pure Cobalt |

The availability of electrodeposited substrates having superplastic properties enables forming of complex structures. The method utilizes the combination of electrodeposition to form the superplastic alloy precursor and superplastic forming to final shape.

Superplastic forming is the tensile deformation of a superplastic alloy at elevated temperatures. The deformation made is grain boundary sliding. Since small grain size is required for sufficient deformation, it is essential that deformation occur below the recrystallization temperature of the electrodeposited superplastic alloy.

Superplastic forming of these alloys requires slow deformation. Deformation rates for the alloys of this invention may range from about $3\times10^{-4}$ in./in./sec. or less to about $8\times10^{-4}$ in./in./sec. or more. Deformation to final shape may be followed by diffusion bonding to obtain 3-dimensional enclosed shapes and seal enclosed cavities and channels.

In particular in forming a complex structure, the approximate initial hardware contour would be formed by electrodeposition, and areas forming internal cavities such as channels would be pre-formed by electrodeposition bonding at the channel edges with the channel centers remaining purposely unbonded. Final hardware fabrication is then achieved by superplastic contour forming of the exterior and interior surfaces. Thus, one of the particular advantages of superplastic forming electrodeposited alloys is that the often required diffusion bonding operation for wrought superplastic alloys can be eliminated. A second advantage is that the fine grain size required to produce superplasticity is present in the as-deposited condition and no subsequent thermal mechanical processing is required. A third advantage of electrodeposition of superplastic alloys is that the grain size can be so small that superplastic deformation occurs at a much lower temperature than can be obtained with wrought superplastic alloys.

The superplastic alloys prepared in accordance with the instant invention, in addition to being formable to any final dimension, can be joined together or to other substrates by welding and brazing, wherein the joint, due to high grain boundary purity, will remain ductile.

Purity of the deposits is essential. If, for instance, sulfur becomes included and welding is attempted, an embrittling heat-affected zone film will form, and the weld will not be ductile.

Workers in the art have attempted to obtain ductile welds by inducing electrolyte filtration. While filtration is of some aid, what is critical is to maintain the bath free of adverse particles, e.g., angstrom-size sulfur-containing nickel oxide, which are so fine that they are not stopped by functional filters.

In sum, the superplastic alloys are weldable without adverse grain structure change, and therefore enable zone heating with retention of high-temperature ductility.

It is to be understood that what has been described is merely illustrative of the principles of the invention and that numerous arrangements in accordance with this invention may be devised by one skilled in the art without departing from the spirit and scope thereof.

What is claimed is:

1. A process for the formation of a superplastic alloy which comprises electrodepositing onto a cathode an alloy from an acidic electrolyte solution substantially free of impurities and anions that increase grain-size or form integranular embrittling films and comprising a first metal ion selected from the group consisting of $Fe^{++}$, $Ni^{++}$ and $Co^{++}$, at least one second constituent different from the first metal ion and selected from ions of the metals iron, nickel, cobalt, tungsten and molybdenum and colloidal dispersoids selected from the group consisting of free metal powders, metal oxides and metal carbides and at least one anion to form a superplastic, fine-grain metal deposit which exhibits grain boundary flow at a superplastic temperature below a recrystallization temperature of the deposit.

2. A process as claimed in claim 1 in which the first metal ion is $Ni^{++}$ and the second constituent is $Co^{++}$, the anion is sulfamate and the electrolyte is substantially halide-free.

3. A process as claimed in claim 2 in which the superplastic alloy formed is a superplastic nickel-cobalt alloy comprised of from about 35 percent to about 70 percent by weight cobalt.

4. A process as claimed in claim 2 in which the superplastic alloy formed is a superplastic nickel-cobalt alloy comprised of from about 40 percent to about 60 percent by weight cobalt.

5. A process as claimed in claim 2 in which the superplastic alloy formed is a superplastic nickel-cobalt alloy comprised of from about 40 percent to about 50 percent by weight cobalt.

6. A process as claimed in claim 1 in which the electrolyte solution has a pH of from about 3.8 to about 4.2 and deposition occurs at a current density of from about 5 to about 60 amps/ft$^2$.

7. A process as claimed in claim 6 in which the current density is from about 20 to about 40 amps/ft$^2$.

8. A process as claimed in claim 1 in which there is present in the electrolyte solution at least one alkyl sulfate containing from about 12 to about 16 carbon atoms in a concentration of from about 0.5 to about 1.0 grams/liter.

9. A process for the electrodeposition of a ductilely weldable, superplastic, fine-grained, nickel-cobalt alloy onto a cathode wherein said alloy contains from about 35 to about 70 percent by weight cobalt, and exhibits fine-grain boundary flow at a superplastic temperature below the recrystallization temperature of the alloy, which comprises the steps of:

preparing a substantially halide-free sulfamic acid electrolyte solution, wherein said solution is substantially free of impurities, is buffered to a pH of from about 3.8 to about 4.2, and comprises a wetting agent in a concentration of from about 0.5 to 1.0 g/l, sulfamate anions, and nickel and cobalt cations, and wherein said nickel cations are present in a concentration of from about 10 to about 25 parts by weight nickel per part cobalt;

maintaining the alloy being deposited at a temperature of from about 115 to about 125 F;

maintaining a current density from about 5 to about 60 amps/ft; and flowing said electrolyte solution in the area of the cathode at a sufficiently high rate to prevent cobalt ion depletion at the cathode.

10. A process as claimed in claim 9 in which the electrolyte is buffered by boric acid.

11. A process as claimed in claim 9 in which the weight ratio of nickel to cobalt in the electrolyte is about 15 to about 20 parts by weight nickel for each part by weight cobalt.

12. A process as claimed in claim 9 in which current density is from about 20 to about 40 amps/ft$^2$.

13. A process as claimed in claim 9 in which the alloy contains from about 40 to about 50 percent by weight cobalt.

14. A process as claimed in claim 9 in which the alloy contains from about 40 to about 60 percent by weight cobalt.

15. A process as claimed in claim 9 in which the wetting agent comprises at least one alkyl sulfate containing from about 12 to about 16 carbon atoms.

16. A process as claimed in claim 9 in which nickel and cobalt are provided to solution by corrosion of separately controlled pure cobalt anodes and sulfur depolarized nickel anodes.

17. A process as claimed in claim 16 further comprising maintaining continual electrodeposition at high electrolyte flow and low current density onto an alternate cathode when not electrodepositing onto a principal cathode to prevent formation of anode oxide.

18. A process for the electrodeposition of a superplastic alloy which comprises:

(a) electrodepositing under conditions of high electrolyte flow onto a dummy cathode an alloy from an acidic electrolyte solution comprising a first metal ion selected from the group consisting of $Fe^{++}$, $Ni^{++}$ and $Co^{++}$, at least one second constituent different from the first metal ion and selected from ions of the metals iron, nickel, cobalt, tungsten and molybdenum and colloidal dispersoids selected from the group consisting of free metal powders, metal oxides and metal carbides and at least one anion for a time sufficient to eliminate substantially all anode oxide particles from the electrolyte solution to form an electrolyte solution substantially free of impurities and anions that increase grain-size growth in the deposit or form intergranular embrittling films; and (b) thereafter electrodepositing onto a principal cathode, an alloy from the electrolyte solution substantially free of anode oxide particles and which forms a superplastic, fine-grain metal deposit exhibiting grain boundary flow at a superplastic temperature below a recrystallization temperature of the deposit.

19. A process as claimed in claim 18 in which the first metal ion is $Ni^{++}$ and the second constituent is $Co^{++}$, the anion is sulfamate and the electrolyte is substantially halide-free.

20. A process as claimed in claim 19 in which the superplastic alloy formed is a superplastic nickel-cobalt alloy comprised of from about 35 percent to about 70 percent by weight cobalt.

21. A process as claimed in claim 19 in which the superplastic alloy formed is a superplastic nickel-cobalt alloy comprised of from about 40 percent to about 60 percent by weight cobalt.

22. A process as claimed in claim 19 in which the superplastic alloy formed is a superplastic nickel-cobalt alloy comprised of from about 40 percent to about 50 percent by weight cobalt.

23. A process as claimed in claim 18 in which the electrodeposition onto the principal cathode is at a current density of from about 5 to about 60 amps/ft$^2$ at an electrolyte pH of from about 3.8 to about 4.2.

24. A process as claimed in claim 18 in which there is present in the electrolyte solution at least one alkyl sulfate containing from about 12 to about 16 carbon atoms in a concentration of from about 0.5 to about 1.0 grams/liter.

25. A process for the electrodeposition of a superplastic alloy onto a plurality of principal cathodes which comprises:

(a) electrodepositing onto a principal cathode an alloy from an acidic electrolyte solution substantially free of impurities and anions that increase grain-size growth or form intergranular embrittling films and comprising a first metal ion selected from the group consisting of $Fe^{++}$, $Ni^{++}$ and $Co^{++}$, at least one second constituent different from the first metal ion and selected from ions of the metals iron, nickel, cobalt, tungsten and molybdenum and colloidal dispersoids selected from the group consisting of free metal powders, metal oxides and metal carbides and at least one anion to form a superplastic, fine-grain metal deposit which exhibits grain boundary flow at a superplastic temperature below a recrystallization temperature of the deposit; and (b) continuously electrodepositing an alloy from the electrolyte solution onto a dummy cathode under conditions of high electrolyte flow and low current density from the time that electrodeposition on the principal cathode is terminated until the commencement of electrodeposition onto another principal cathode.

26. A process as claimed in claim 25 in which the first metal ion is $Ni^{++}$ and the second constituent is $Co^{++}$, the anion is sulfamate and the electrolyte is substantially halide-free.

27. A process as claimed in claim 26 in which the superplastic alloy formed is a superplastic nickel-cobalt alloy comprised of from about 35 percent to about 70 percent by weight cobalt.

28. A process as claimed in claim 26 in which the superplastic alloy formed is a superplastic nickel-cobalt alloy comprised of from about 40 percent to about 60 percent by weight cobalt.

29. A process as claimed in claim 26 in which the superplastic alloy formed is a superplastic nickel-cobalt alloy comprised of from about 40 percent to about 50 percent by weight cobalt.

30. A process as claimed in claim 25 in which the electrodeposition onto the principal cathode is at a current density of from about 5 to about 60 amps/$ft^2$ at a solution pH of from about 3.8 lo about 4.2.

31. A process as claimed in claim 25 in which there is present in the electrolyte solution at least one alkyl sulfate containing from about 12 to about 16 carbon atoms in a concentration of from about 0.5 to about 1.0 grams/liter.

32. A process for the electrodeposition of a superplastic alloy which comprises:

(a) electrodepositing onto a dummy cathode an alloy from an acidic electrolyte solution comprising a first metal ion selected from the group consisting of $Fe^{++}$, $Ni^{++}$ and $Co^{++}$, at least one second constituent different from the first metal ion and selected from ions of the metals iron, nickel, cobalt, tungsten and molybdenum and colloidal dispersoids selected from the group consisting of free metal powders, metal oxides and metal carbides and at least one anion for a time sufficient to eliminate substantially all anode oxide particles from the electrolyte solution to form an electrolyte solution substantially free of impurities and anions that increase grain-size in the deposit or form intergranular embrittling films, said deposition occurring at low current density and high electrolyte flow;

(b) thereafter electrodepositing onto a principal cathode, an alloy from the electrolyte solution which forms a superplastic, fine-grain metal deposit exhibiting grain boundary flow at a superplastic temperature below a recrystallization temperature of the deposit; and (c) continuously electrodepositing an alloy from the electrolyte solution onto the dummy cathode under conditions of high electrolyte flow and low current density from the time that electrodeposition on the principal cathode is terminated until the commencement of electrodeposition onto another principal cathode.

33. A process as claimed in claim 32 is which electrodeposition of the superplastic deposit occurs at a current density of from about 5 to about 60 amp/$ft^2$ and a pH of from about 3.8 to about 4.2.

34. A process for the formation of a superplastic alloy structure which comprises in combination:

(a) electrodepositing onto a cathode an alloy from an acidic electrolyte solution substantially free of impurities and anions that increase grain-size or form intergranular embrittling films and comprising a first metal ion selected from the group consisting of $Fe^{++}$, $Ni^{++}$ and $Co^{++}$, at least one second constituent different from the first metal ion and selected from ions of the metals iron, nickel, cobalt, tungsten and molybdenum and colloidal dispersoids selected from the group consisting of free metal powders, metal oxides and metal carbides and at least one anion to form a superplastic, fine-grain metal precursor of the structure which precursor exhibits grain boundary flow at a superplastic temperature below a recrystallizaton temperature of the deposit; and (b) removing the superplastic, fine grain metal precursor from the cathode and forming the precursor into the shape of the superplastic alloy structure by deformation of the precursor under conditions of tensile deformation with grain boundary sliding at an elevated superplastic temperature below the recrystallization temperature of the precursor.

35. A process for the formation of a superplastic alloy structure which comprises in combination:

(a) forming the approximate initial hardware contour by electrodepositing an alloy from an acidic electrolyte solution substantially free of impurities and anions that increase grain-size or form intergranular embrittling films and comprising a first metal ion selected from the group consisting of $Fe^{++}$, $Ni^{++}$, and $Co^{++}$, at least one second constituent dif from the first metal ion and selected from ions of the metals iron, nickel, cobalt, tungsten and molybdenum and colloidal dispersoids selected from the group consisting of free metal powders, metal oxides and metal carbides and at least one anion to form a superplastic, fine-grain metal deposit of the structure which exhibits grain boundary flow at a superplastic temperature below a recrystallization temperature of the deposit, said deposit and cathode forming a precursor of the structure; and (b) forming the precursor of the structure into the shape of the superplastic alloy structure by deformation of the precursor of the structure under conditions of tensile deformation with grain boundary sliding at an elevated superplastic temperature below the recrystallization temperature of the precursor.

36. A process for formation of a superplastic alloy structure which comprises in combination:

(a) forming the approximate initial hardware contour by electrodepositing onto a wrought superplastic cathode an alloy from an acidic electrolytic solution substantially free of impurities and anions that increase grain-size or form intergranular embrittling films and comprising a first metal ion selected from the group consisting of $Fe^{++}$, $Ni^{++}$, and $Co^{++}$, at least one second constituent different from the first metal ion and selected from ions of the metals iron, nickel, cobalt, tungsten and molybdenum and colloidal dispersoids selected from the group consisting of free metal powders, metal oxides and metal carbides and at least one anion to form a superplastic, fine-grain metal deposit of the structure which exhibits grain boundary flow at a superplastic temperature below a recrystallization temperature of the deposit, said deposit and cathode forming a precursor of the structure; and (b) forming the precursor of the structure into the shape of the superplastic alloy structure by deforaation of the precursor of the structure under conditions of tensile deformation with grain boundary sliding at an elevated superplastic temperature below the recrystallization temperature of the precursor.

37. A superplastic alloy formed in accordance with the process of claim 1.

38. A superplastic alloy formed in accordance with the process of claim 9.

39. A superplastic alloy formed in accordance with the process of claim 18.

40. A superplastic alloy formed in accordance with the process of claim 25.

41. A superplastic alloy formed in accordance with the process of claim 32.

42. A superplastic alloy structure formed in accordance with the process of claim 34.

43. A superplastic alloy structure formed in accordance with the process of claim 35.

44. A superplastic alloy structure formed in accordance with the process of claim 36.

* * * * *